US010644427B2

(12) United States Patent
Matsuura

(10) Patent No.: US 10,644,427 B2
(45) Date of Patent: May 5, 2020

(54) CONNECTOR

(71) Applicant: Sumitomo Wiring Systems, Ltd., Yokkaichi, Mie (JP)

(72) Inventor: Junya Matsuura, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/273,351

(22) Filed: Feb. 12, 2019

(65) Prior Publication Data

US 2019/0273337 A1 Sep. 5, 2019

(30) Foreign Application Priority Data

Mar. 5, 2018 (JP) ..... 2018-038414

(51) Int. Cl.
*H01R 13/422* (2006.01)
*H01R 13/506* (2006.01)

(52) U.S. Cl.
CPC ..... *H01R 13/4223* (2013.01); *H01R 13/506* (2013.01)

(58) Field of Classification Search
CPC ..... H01R 13/4223; H01R 13/4226; H01R 13/506
USPC ..... 439/595, 752
See application file for complete search history.

(56) References Cited

U.S. PATENT DOCUMENTS 5,562,495 A * 10/1996 Kakitani ..... H01R 13/4223 439/595
5,733,144 A * 3/1998 Tsuji ..... H01R 13/4223 439/595
6,364,705 B1 * 4/2002 Yamamoto ..... H01R 13/4223 439/595
6,769,934 B2 * 8/2004 Nakamura ..... H01R 13/4223 439/595
2006/0281373 A1 * 12/2006 Anbo ..... H01R 13/4367 439/752
2012/0309219 A1 * 12/2012 Hiraishi ..... H01R 13/4223 439/352
2013/0260598 A1 * 10/2013 Chikusa ..... H01R 13/6275 439/357
2015/0340793 A1 11/2015 Kutsuna et al.
2016/0072218 A1 * 3/2016 Chiba ..... H01R 13/4223 439/587
2016/0365664 A1 * 12/2016 Chikusa ..... H01R 13/4223
2017/0117657 A1 * 4/2017 Inoue ..... H01R 13/4364

FOREIGN PATENT DOCUMENTS

JP 2014-107233 6/2014

* cited by examiner

*Primary Examiner* — Gary F Paumen
(74) *Attorney, Agent, or Firm* — Gerald E. Hespos; Michael J. Porco; Matthew T. Hespos

(57) ABSTRACT

A connector includes a housing (10) formed with a terminal accommodation chamber (13), a terminal fitting (21) to be inserted into the terminal accommodation chamber (13) from behind the housing (10), a locking lance (14) disposed to face the terminal accommodation chamber (13), cantilevered forward and resiliently displaceable in a direction away from the terminal accommodation chamber (13) and in a direction to enter the terminal accommodation chamber (13), and a recess (20) formed in an area on a side of the locking lance (14) opposite to the terminal accommodation chamber (13).

8 Claims, 10 Drawing Sheets

CONNECTOR

BACKGROUND

Field of the Invention

The invention relates to a connector.

Related Art

Japanese Unexamined Patent Publication No. 2014-107233 discloses a connector in which a terminal fitting inserted into a terminal accommodation chamber of a housing from behind is retained by a locking action of a locking lance. The locking lance is cantilevered forward along an inner wall surface of the terminal accommodation chamber. In the process of inserting the terminal fitting, the locking lance interferes with the terminal fitting and is displaced resiliently to retract from an insertion path for the terminal fitting. The locking lance resiliently returns to lock the terminal fitting when the terminal fitting reaches a proper insertion position. Thus, the terminal fitting is retained.

The terminal fitting that is retained by the locking lance may be pulled reward. Thus, the locking lance is displaced toward the insertion path for the terminal fitting and shear stress is generated in the locking lance due to a pressing force from the terminal fitting. The larger a shear area of the locking lance at this time, the larger a holding force of the locking lance. To ensure a large shear area, a thickness of the locking lance in a resilient displacing direction may be increased.

However, the flexural rigidity of the locking lance increases if the thickness of the locking lance in the displacing direction is increased. A locking lance with increased structural rigidity has a large resilient restoring force when the locking lance is deformed resiliently in the process of inserting the terminal fitting and insertion resistance due to a friction force between the locking lance and the terminal fitting increases.

The invention was completed on the basis of the above situation and aims to reduce insertion resistance in the process of inserting a terminal fitting without reducing a holding force of a locking lance retaining the terminal fitting.

SUMMARY

The invention is directed to a connector with a housing formed with a terminal accommodation chamber, a terminal fitting to be inserted into the terminal accommodation chamber from behind the housing, and a locking lance disposed to face the terminal accommodation chamber. The locking lance is cantilevered forward and is resiliently displaceable in a direction away from the terminal accommodation chamber and in a direction to enter the terminal accommodation chamber. A recess is formed in an area on a side of the locking lance opposite to the terminal accommodation chamber.

Since the locking lance is resiliently displaced with a locally thinned part where the recess is formed as a supporting point, the flexural rigidity of the locking lance is suppressed low. Further, since the recess is formed in the area on the side opposite to the terminal accommodation chamber, out of the outer surface of the locking lance, a shear area of the locking lance when the terminal fitting retained by the locking lance is pulled rearward and the locking lance is resiliently displaced toward the terminal accommodation chamber is not reduced due to the formation of the recess. Thus, insertion resistance in the process of inserting the terminal fitting can be reduced without reducing a holding force of the locking lance retaining the terminal fitting.

The recess may be in a rear part of the locking lance. This configuration suppresses flexural rigidity of the locking lance even more and further reduces insertion resistance.

The recess may include a curved inner surface. This configuration distributes stress generated in the recess when the locking lance is displaced resiliently and prevents improper deformation of the locking lance due to the concentration of stress.

The housing may be formed by stacking two sub-housings. Each sub-housing has the recess exposed in an outer surface, such that the recesses face each other. The structures of molds for molding the sub-housings can be simplified as compared to the case where the recesses are not exposed in the outer surfaces of the sub-housings.

A front surface of the locking lance may include a first locking surface for locking the terminal fitting from behind with the locking lance resiliently displaced, and a second locking surface for locking the terminal fitting from behind with a resilient displacement amount of the locking lance increased when the terminal fitting is displaced rearward from a locking position by the first locking surface. According to this configuration, even if an angle of inclination of the locking lance changes as the locking lance is displaced resiliently, the first and second locking surfaces in proper orientations lock the terminal fitting. Therefore, the locking lance exhibits excellent retaining reliability.

DETAILED DESCRIPTION

Figure 1:
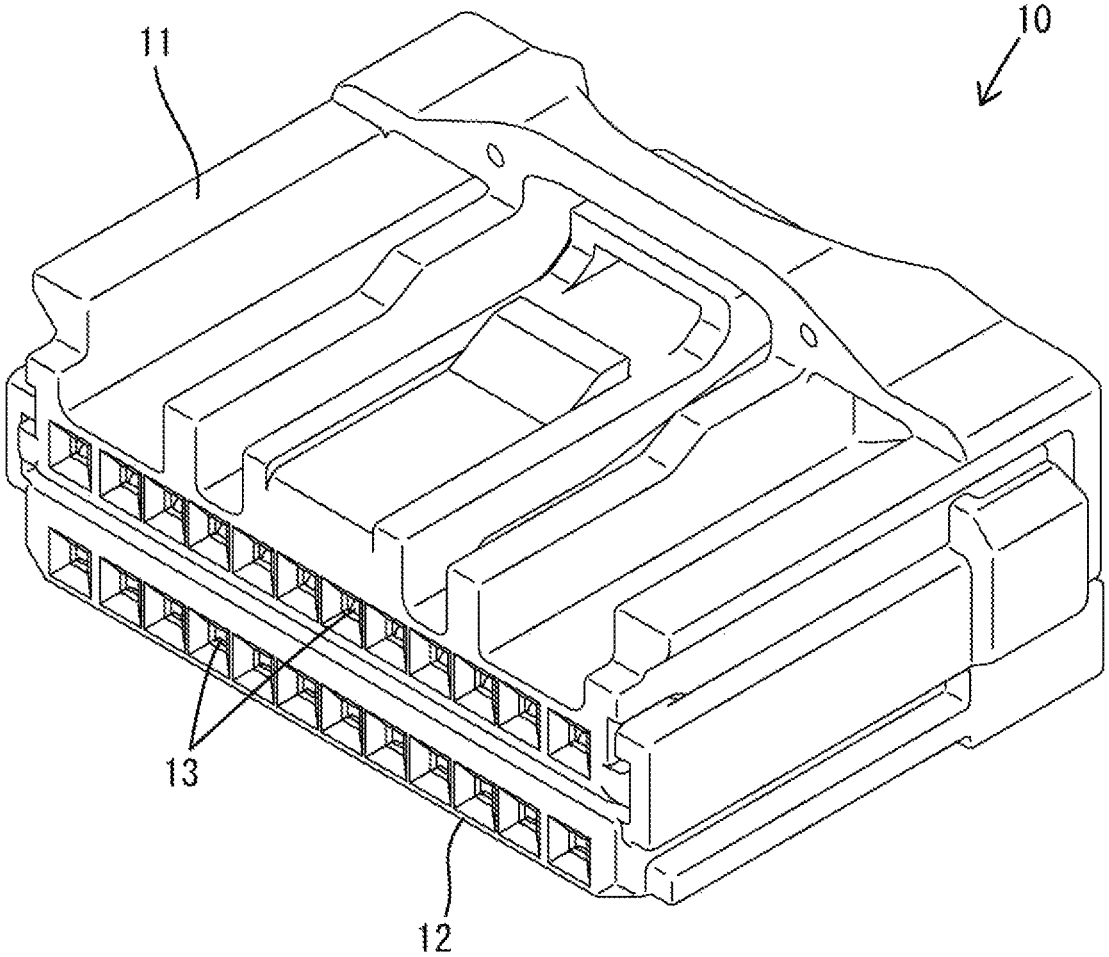
FIG. 1 is a perspective view of a connector of a first embodiment.
Figure 2:
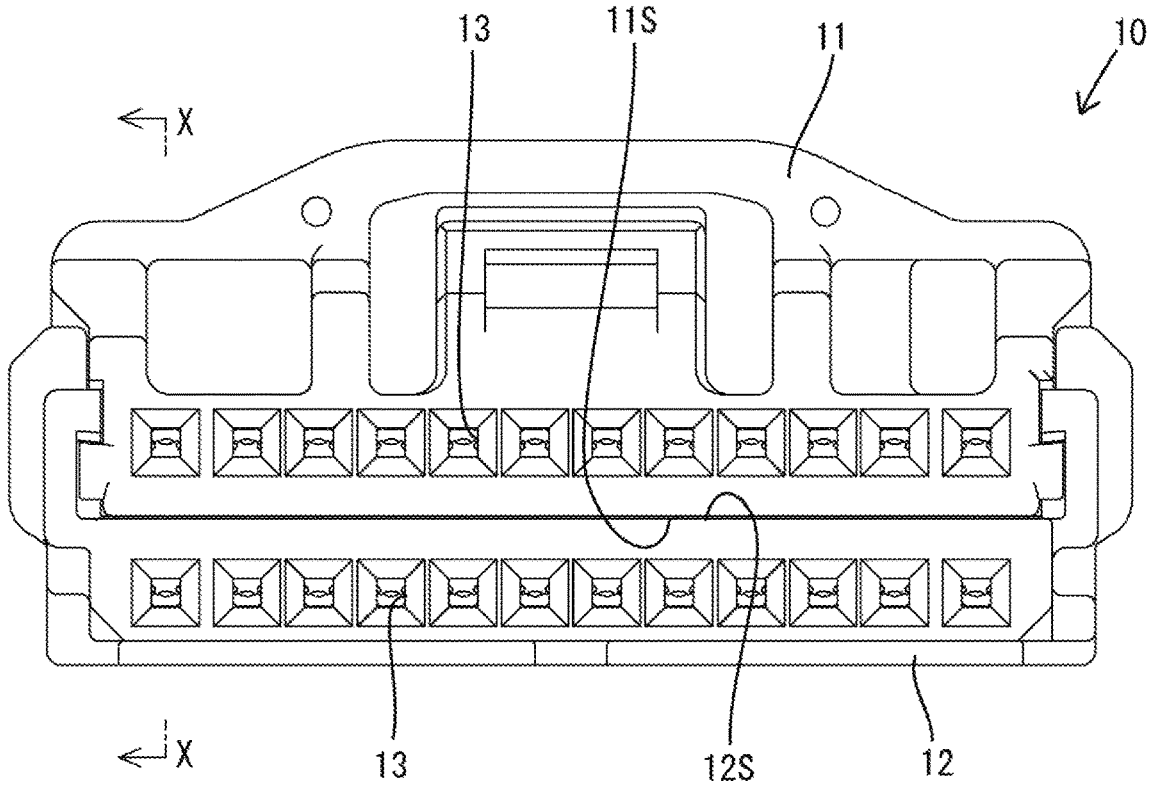
FIG. 2 is a front view of the connector.

A first embodiment of the invention is described with reference to FIGS. 1 to 10. Note that, in the following description, a left side in FIGS. 1, 3 to 10 is defined as a front concerning a front-rear direction. Upper and lower sides shown in FIGS. 1 to 10 are defined as upper and lower sides concerning a vertical direction.

A connector of the first embodiment includes a housing 10 and terminal fittings 21. The housing 10 includes upper and lower sub-housings 11 that are made of synthetic resin. Each sub-housing 11 is flat and has a substantially rectangular shape in a plan view. The upper and lower sub-housings 11, 12 are stacked vertically with an upper stacking surface 11S of the upper sub-housing 11 and a lower stacking surface 12S of the lower sub-housing 12 proximately facing each other or held in surface contact with each other.

Laterally juxtaposed terminal accommodation chambers 13 penetrate through the upper sub-housing 11 in the front-rear direction and locking lances 14 are disposed to face the respective terminal accommodation chambers 13. Each locking lance 14 constitutes a part of a lower wall of the terminal accommodation chamber 13 and is exposed to the outside of the upper housing 11 in the upper-side stacking surface 11S.

The locking lance 14 of the upper sub-housing 11 is cantilevered forward and is resiliently displaceable in the vertical direction with a rear end part as a support. An area of each locking lance 14 in the upper sub-housing 11 has a terminal facing surface 15 facing the terminal accommodation chamber 13 and also facing the lower surface of the terminal fitting 21 in the terminal accommodation chamber 13. Facing directions of the terminal fitting 21 and the terminal facing surface 15 are substantially parallel to a resilient displacing direction of the locking lance 14. An area of each locking lance 14 in the upper sub-housing 11 also has a stacking back surface 16 on a side opposite to the terminal facing surface 15 and also flush with the upper-side stacking surface 11S.

The front surface of the locking lance 14 has first and second locking surfaces 17 and 18 having different angles of inclination. The first locking surface 17 is a flat surface with an upper end part of the first locking surface 17 connected at an acute angle to the terminal facing surface 15. In a free state where the locking lance 14 is not resiliently displaced, an angle of inclination of the first locking surface 17 with respect to the upper-side stacking surface 11S is an angle close to and smaller than a right angle.

The second locking surface 18 is a flat surface. An upper end part of the second locking surface 18 is connected at an obtuse angle to the lower end part of the first locking surface 17. In the free state of the locking lance 14, an angle of inclination of the second locking surface 18 with respect to the upper-side stacking surface 11S is an angle smaller than that of the first locking surface 17. The lower end part of the second locking surface 18 is connected at an obtuse angle to the stacking back surface 16.

A restricting projection 19 projects up from the terminal facing surface 15 of the locking lance 14 and toward the terminal accommodation chamber 13 from a substantially half area of the terminal facing surface 15 in a width direction. A stabilizer of the terminal fitting 21 butts against the rear surface of the restricting projection 19 when the terminal fitting 21 is inserted into the terminal accommodation chamber 13 in a vertically inverted improper posture. This butting prevents the terminal fitting 21 from being inserted in an improper posture. An area of the terminal facing surface 15 in the width direction where the restricting projection 19 is not formed is inclined gently up toward the front.

The lower sub-housing 12 also is formed with laterally juxtaposed terminal accommodation chambers 13 similar to those of the upper sub-housing 11. Locking lances 14 are formed in the lower sub-housing 12 and face the respective terminal accommodation chambers 13 similarly to the upper housing 11. Each locking lance 14 of the lower sub-housing 12 is a part of an upper wall of the terminal accommodation chamber 13 and is exposed to the outside of the lower sub-housing 12 in the lower-side stacking surface 12S.

The locking lances 14 of the two housings 11 and 12 are point-symmetrical with respect to an axis in the front-rear direction (inserting and withdrawing directions of the terminal fitting 21 into and from the terminal accommodation chamber 13). The front surface of the locking lance 14 of the lower housing 12 is composed of a flat first and second locking surfaces 17 and 18. One end (lower end) of the first locking surface 17 is connected at an acute angle to the terminal facing surface 15. In a free state where the locking lance 14 is not displaced resiliently, an angle of inclination of the first locking surface 17 with respect to the lower stacking surface 12S is an angle close to and smaller than a right angle. One end of the second locking surface 18 is connected at an obtuse angle to the other end (upper end) of the first locking surface 17. In the free state of the locking lance 14, an angle of inclination of the second locking surface 18 with respect to the lower stacking surface 12S is smaller than that of the first locking surface 17.

The locking lances 14 of the upper and lower sub-housings 11 and 12 are formed respectively with recesses 20 by partially recessing the stacking back surface 16 of each locking lance 14. With the upper and lower housings 11 and 12 separated, each recess 20 of the upper sub-housing 11 is exposed to the outside in the upper stacking surface 11S. With the upper and lower sub-housings 11 and 12 separated, each recess 20 of the lower housing 12 is exposed to the outside in the lower-side stacking surface 12S.

Each recess 20 is disposed in a rear end part of the locking lance 14 in the front-rear direction. In a lateral direction (width direction of the locking lance 14), the recess 20 is formed over the entire width of the locking lance 14 and both left and right ends of the recess 20 are open to both left and right outer side surfaces of the locking lance 14. An inner surface of the recess 20 is composed only of a curved surface having a constant curvature (i.e. arcuate surface) in a side view. A front part of the inner surface of the recess 20 is connected at an obtuse angle to a rear part of the stacking back surface 16. A rear part of the inner surface of the recess 20 is connected at an obtuse angle to the upper-side stacking surface 11S.

The terminal fitting 21 is long and narrow in the front-rear direction. A rectangular tubular terminal body 22 is formed in a front part of the terminal fitting, and a crimping portion (not shown) in the form of an open barrel to be connected to a wire (not shown) is formed in a rear part of the terminal fitting 21. The terminal body 22 is formed with a locking portion 23, a locking projection 24 and the stabilizer (not shown). The locking portion 23 is formed by cutting an outer surface of the terminal body 22 and the locking projection 24 projects out from a front edge of an opening edge of the locking portion 23. The stabilizer is formed in an area on a side vertically opposite to the locking portion 23 and the locking projection 24, out of the outer surface of the terminal body portion 22.

In the process of inserting the terminal fitting 21 into the terminal accommodation chamber 13, the locking lance 14 interferes with the terminal body 22 and is displaced resiliently away from the terminal accommodation chamber 13 with the rear end part (i.e. recess 20) of the locking lance 14 as a support, and projects farther out than the upper-side stacking surface 11S or lower-side stacking surface 12S. A thickness of the recess 20 serving as a support of deflection of the locking lance 14 in the vertical direction (resilient displacing direction of the locking lance 14) at this time is smaller than a thickness of an area of the locking lance 14 other than the recess 20.

Accordingly, a resilient restoring force when the locking lance 14 is displaced resiliently is small, and insertion resistance due to friction between the locking lance 14 and the terminal fitting 21 is reduced. Inserting and withdrawing the terminal fitting 21 into and from the terminal accommodation chamber 13 are performed with the upper and lower sub-housings 11, 12 separated. The upper and lower sub-housings 11, 12 are united vertically after all of the terminal fittings 21 are inserted into the terminal accommodation chambers 13.

Figure 3:
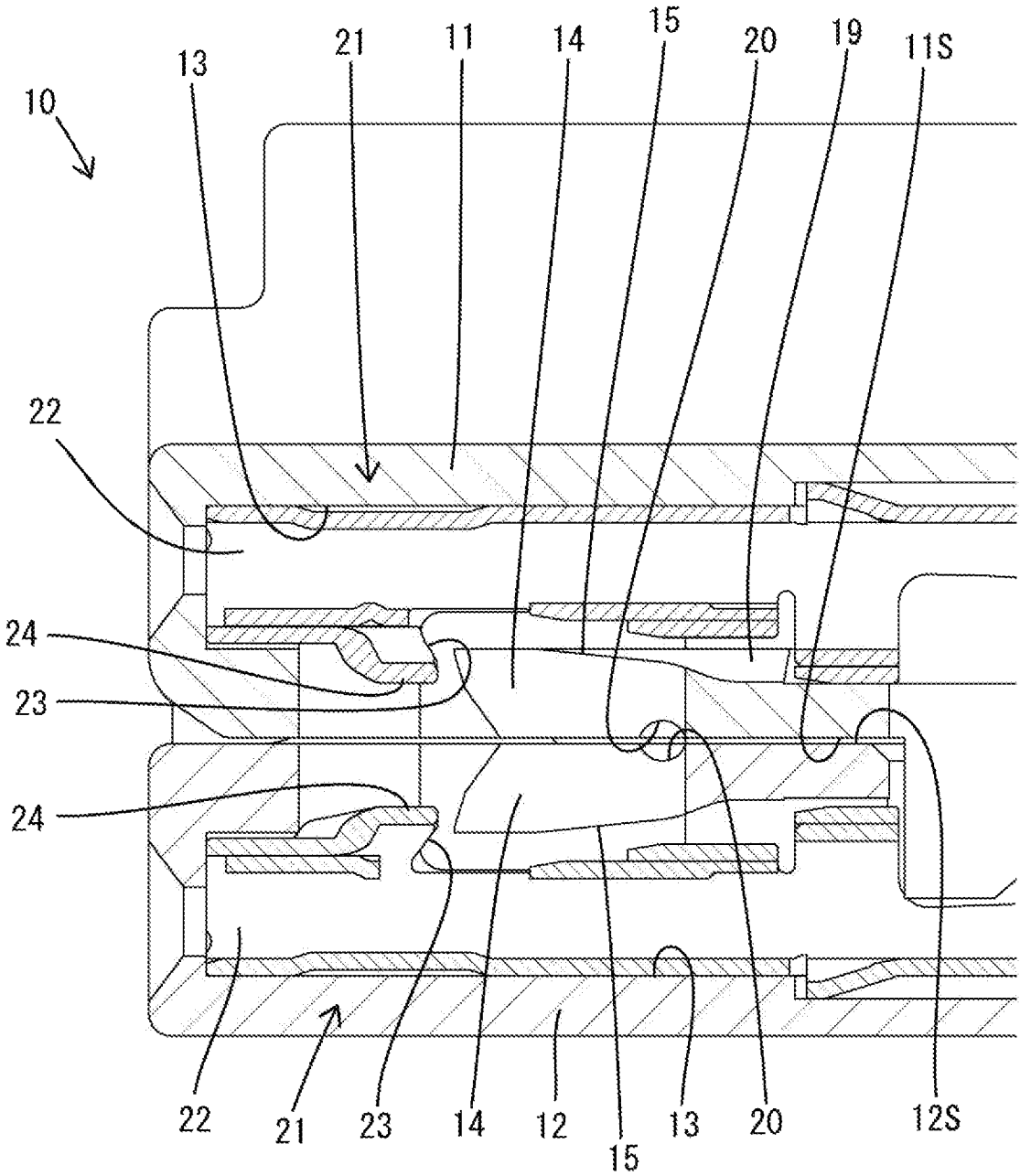
FIG. 3 is a section along X-X of FIG. 2.
Figure 4:
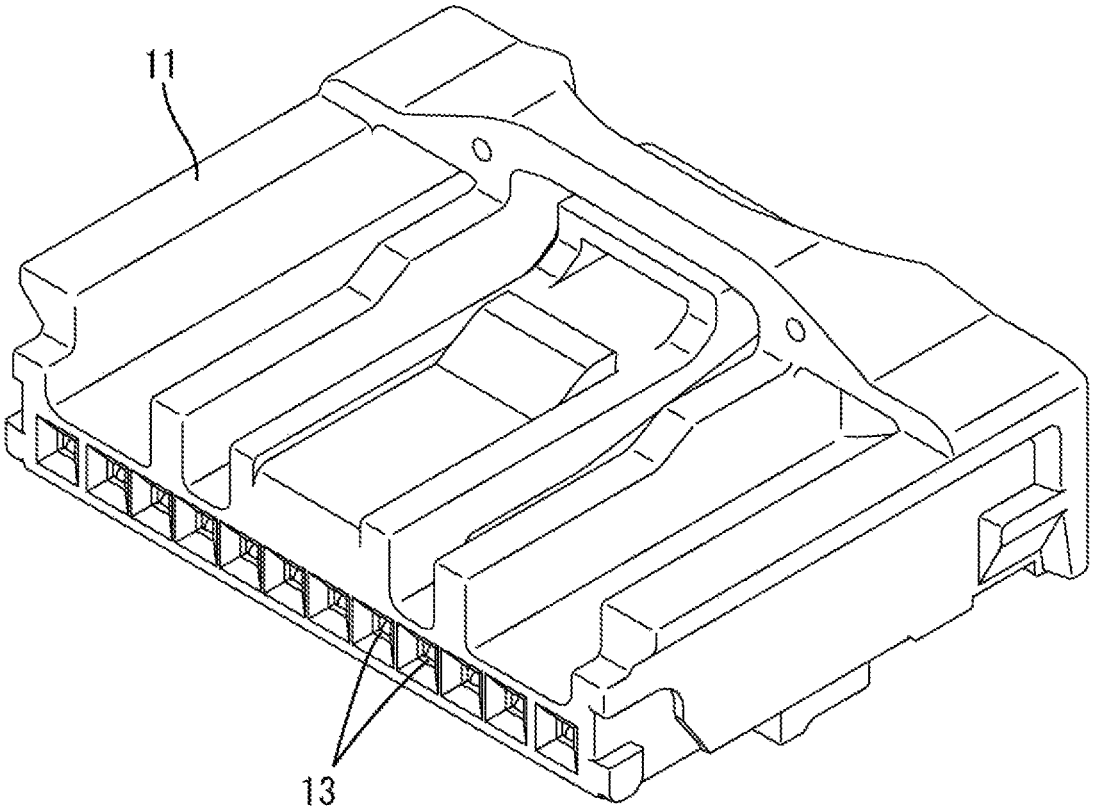
FIG. 4 is a perspective view of an upper housing.
Figure 5:
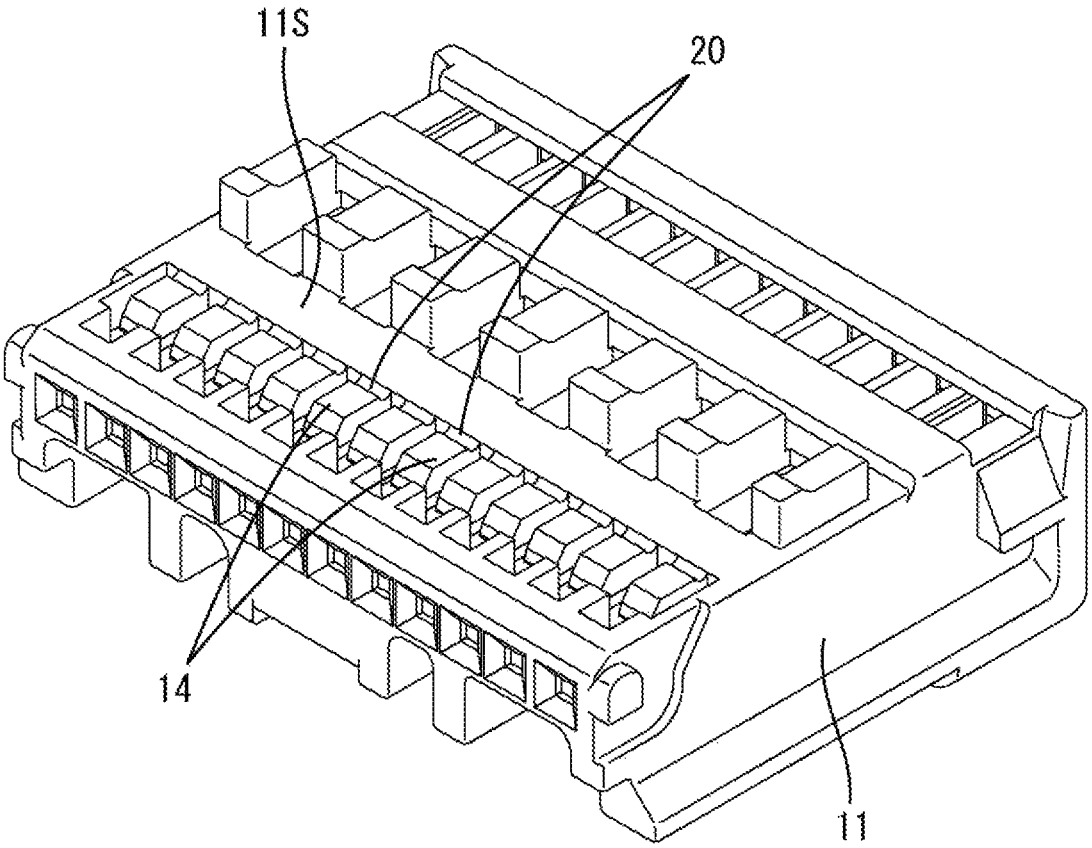
FIG. 5 is a perspective view of the upper housing in a vertically inverted state.
Figure 6:
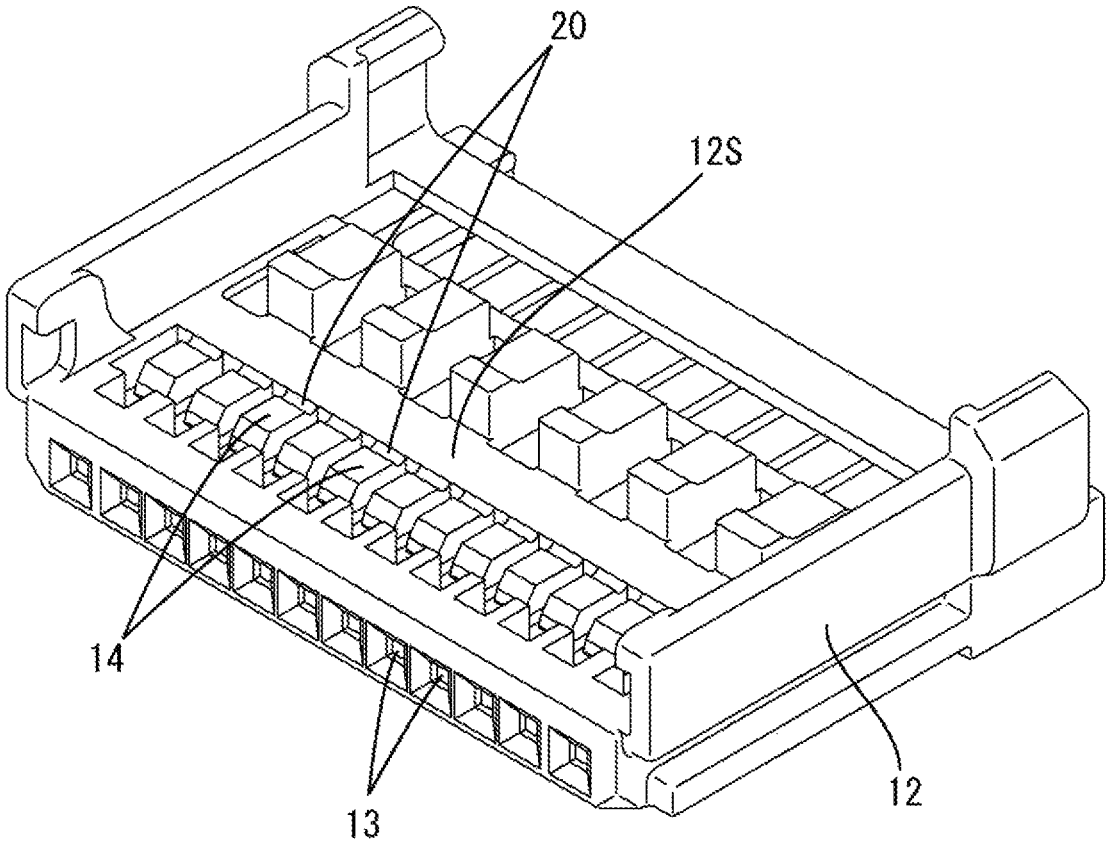
FIG. 6 is a perspective view of a lower housing.
Figure 7:
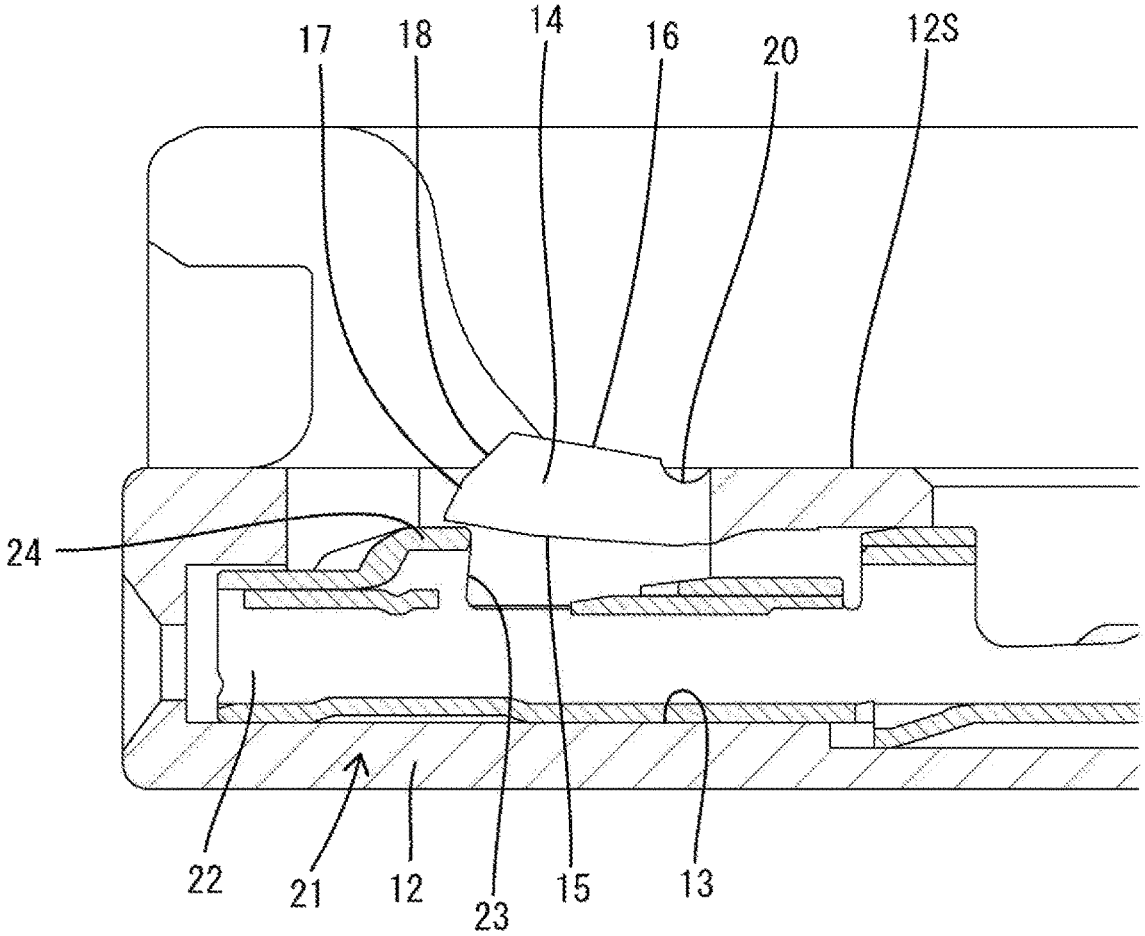
FIG. 7 is a partially enlarged side view in section showing a state where a locking lance is resiliently displaced in the process of inserting a terminal fitting in the lower housing.
Figure 8:
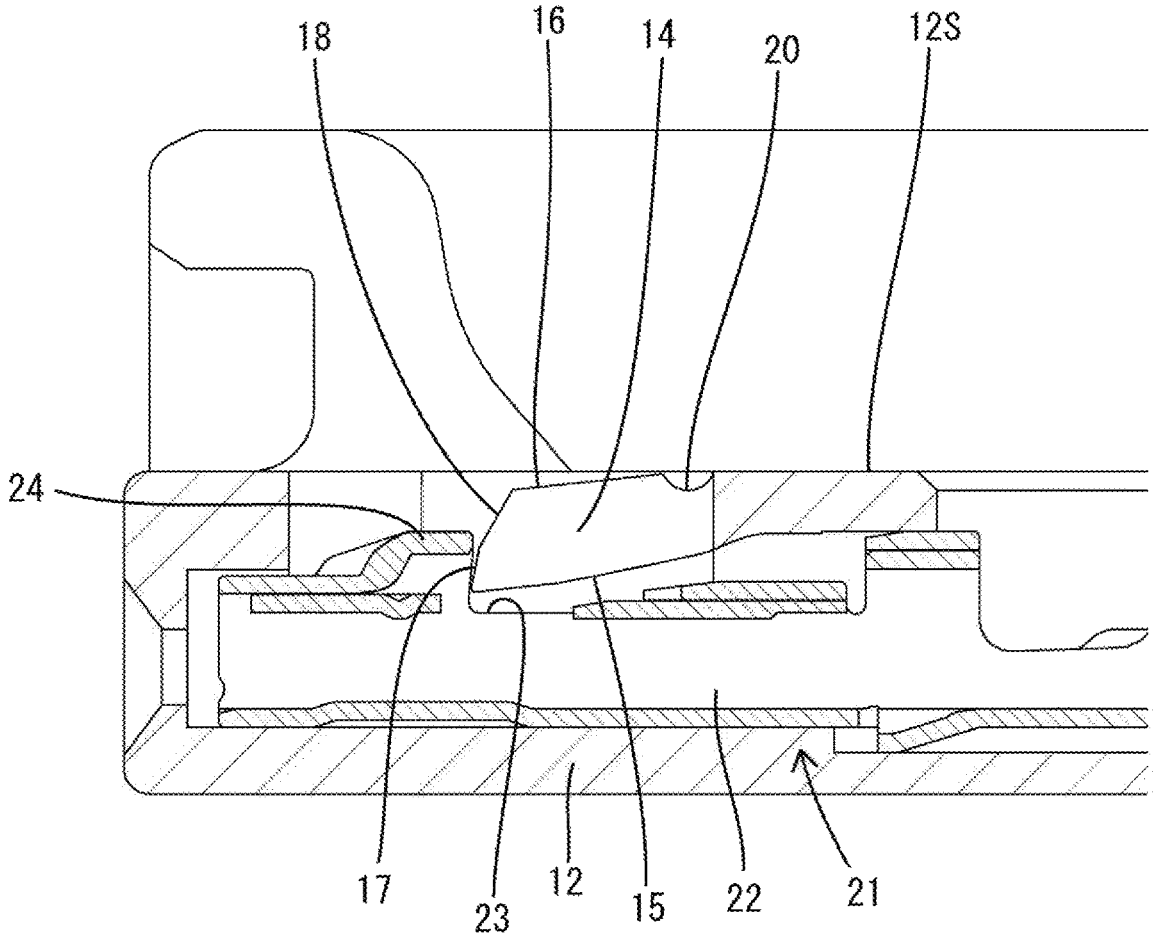
FIG. 8 is a partially enlarged side view in section showing a state where the locking lance is resiliently displaced as the terminal fitting is pulled rearward in the lower housing.
Figure 9:
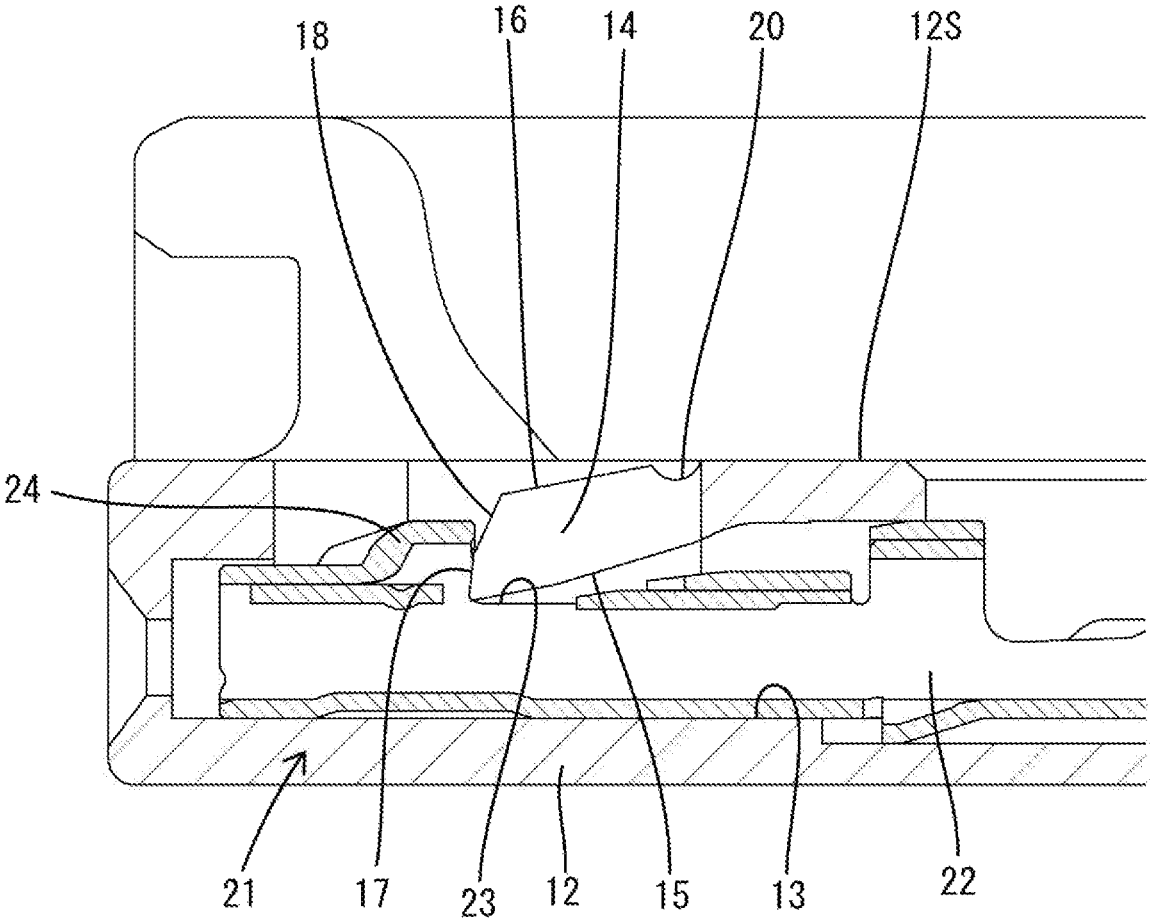
FIG. 9 is a side sectional view in section showing a state where the locking lance is displaced farther as the terminal fitting is pulled farther rearward from the state of FIG. 8.
Figure 10:
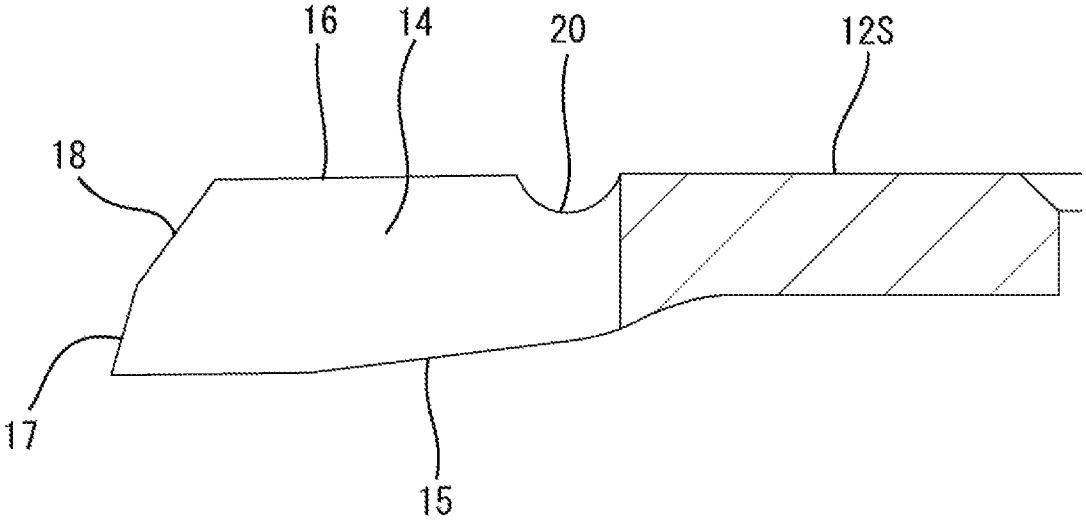
FIG. 10 is an enlarged side view of the locking lance.

The front part of the locking lance 14 faces the locking projection 24 of the terminal fitting 21 from behind with the terminal fitting 21 inserted to a proper position in the terminal accommodation chamber 13, as shown in FIG. 3. If the terminal fitting 21 is pulled rearward from this state, the locking projection 24 contacts the first locking surface 17, as shown in FIGS. 8 and 9 when the terminal fitting 21 is retracted slightly. In a state where the locking lance 14 is not displaced resiliently, the first locking surface 17 is inclined with respect to the front-rear direction (inserting and withdrawing directions of the terminal fitting 21 into and from the terminal accommodation chamber 13). Thus, the locking lance 14 is displaced resiliently in a direction (down) to enter the terminal accommodation chamber 13 and the front part of the locking lance 14 enters the locking portion 23. As the locking lance 14 is displaced resiliently, the first locking surface 17 is oriented at an angle close to a right angle with respect to the inserting and withdrawing directions of the terminal fitting 21. Thus, the terminal fitting 21 is retained reliably by the first locking surface 17.

Shear stress is generated in the locking lance 14 in a direction parallel to a pulling direction of the terminal fitting 21 when the locking lance 14 is displaced resiliently toward the terminal accommodation chamber 13. When a virtual shear surface (not shown) parallel to the shear stress is assumed with a contact position of the first locking surface 17 of the locking lance 14 and the locking projection 24 as a starting point, the larger the area of this virtual shear surface, the higher the shear strength of the locking lance 14 and, eventually, the larger a force for holding the terminal fitting 21 (force for retaining the terminal fitting 21) by the locking lance 14.

The terminal fitting 21 may be pulled and displaced farther rearward from a position where the terminal fitting 21 is locked by the first locking surface 17, as shown in FIG. 9. Thus, the locking lance 14 is displaced farther toward the terminal accommodation chamber 13 and the second locking surface 18 and the locking projection 24 are locked. An angle of inclination of the locking lance 14 increases if a resilient displacement amount of the locking lance 14 increases. Thus, the second locking surface 18 is at an angle close to a right angle with respect to a displacing direction of the terminal fitting 21. In this way, the second locking surface 18 reliably retains the terminal fitting 21.

The locking lance 14 has the recess 20 for reducing the insertion resistance of the terminal fitting 21. The recess 20 is on the side vertically opposite to the first locking surface 17 (side close to the second locking surface 18). Thus, the virtual shear surface does not cross the recess 20, and the recess 20 does not reduce the holding force of the locking lance 14.

As described above, the connector of the first embodiment includes the housing 10 formed with the terminal accommodation chambers 13, the terminal fittings 21 to be inserted into the terminal accommodation chambers 13 from behind the housing 10, and the locking lances 14 cantilevered forward to face the terminal accommodation chambers 13. The locking lance 14 is resiliently displaceable away from the terminal accommodation chamber 13 and in the direction to enter the terminal accommodation chamber 13. The locking lance 14 is formed with the recess 20 in the area (stacking back surface 16) on the side opposite to the terminal accommodation chamber 13.

The locking lance 14 is displaced resiliently with a locally thinned part where the recess 20 is formed as a support. Thus, the flexural rigidity of the locking lance 14 is low. Further, the recess 20 is on the side opposite to the terminal accommodation chamber 13. Thus, the shear area of the locking lance 14 when the terminal fitting 21 retained by the locking lance 14 is pulled rearward and the locking lance 14 is resiliently displaced toward the terminal accommodation chamber 13 is not reduced due to the formation of the recess 20. Thus, insertion resistance in the process of inserting the terminal fitting 21 can be reduced without reducing the holding force of the locking lance 14 retaining the terminal fitting 21.

The recess 20 is disposed in the rear part of the locking lance 14. Thus, flexural rigidity of the locking lance 14 is suppressed maximally, and insertion resistance is reduced. Further, the curved inner surface of the recess 20 distributes stress generated in the recess 20 when the locking lance 14 is displaced resiliently, thereby preventing the locking lance 14 from being deformed improperly due to a concentration of stress on the recess 20.

The housing 10 is formed by stacking upper and lower sub-housings 11 and 12 such that the recesses 20 are exposed in the outer surfaces and face each other. Thus, the recesses 20 are exposed in the outer surfaces of the upper and lower sub-housings 11, 12 (upper and lower stacking surfaces 11S and 12S), and the molds for molding the upper and lower housings 11 and 12 can be simplified as compared to the case where the recesses 20 are not exposed in the outer surfaces of the upper and lower sub-housings 11, 12.

The front surface of the locking lance 14 includes the first locking surface 17 for locking the terminal fitting 21 from behind with the locking lance 14 resiliently displaced and the second locking surface 18 for locking the terminal fitting 21 from behind with the resilient displacement amount of the locking lance 14 increased when the terminal fitting 21 is displaced rearward from the locking position by the first locking surface 17. Accordingly, even if an angle of inclination of the locking lance 14 changes as the locking lance 14 is displaced resiliently, the first and second locking surfaces 17, 18 are in proper orientations to lock the terminal fitting 21 so that the terminal fitting 21 is retained reliably.

Figure 11:
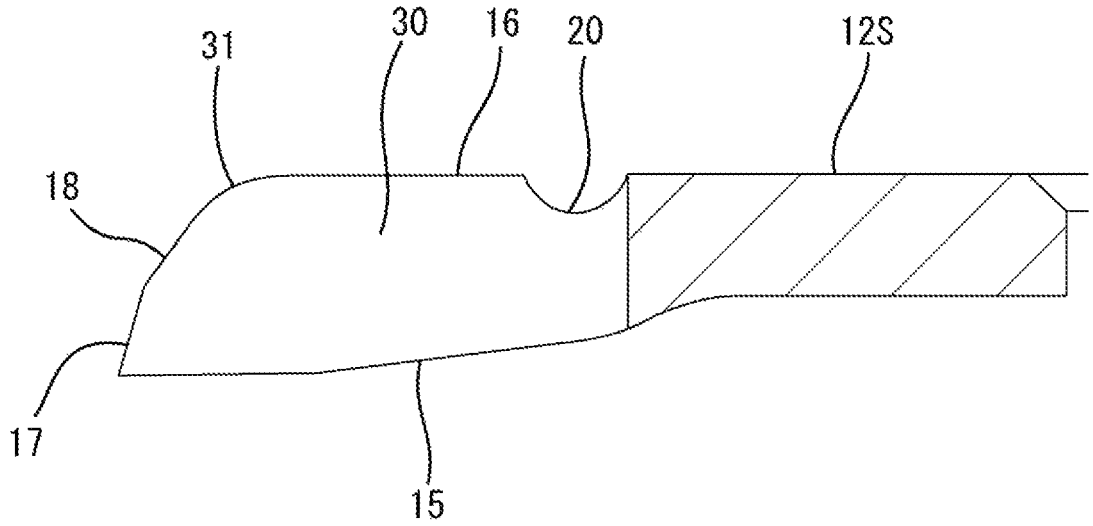
FIG. 11 is an enlarged side view of a locking lance of a second embodiment.

FIG. 11 shows a locking lance 30 of a lower sub-housing 12 according to a second embodiment of the invention. The front surface of this locking lance 30 includes first and second locking surfaces 17 and 18 similar to the locking lance 14 of the first embodiment. An area connecting the front surface (second locking surface 18) and a front end part of a stacking back surface 16 (surface where a recess 20 is formed), is a coupling curved surface 31 arcuate in a side view. A lower part of the coupling curved surface 31 is connected smoothly tangentially to an upper part of the second locking surface 18. A rear part of the coupling curved surface 31 is connected smoothly tangentially to a front part of the stacking back surface 16. Note that the configuration other than the above is the same as in the first embodiment and, hence, not described.

Figure 12:
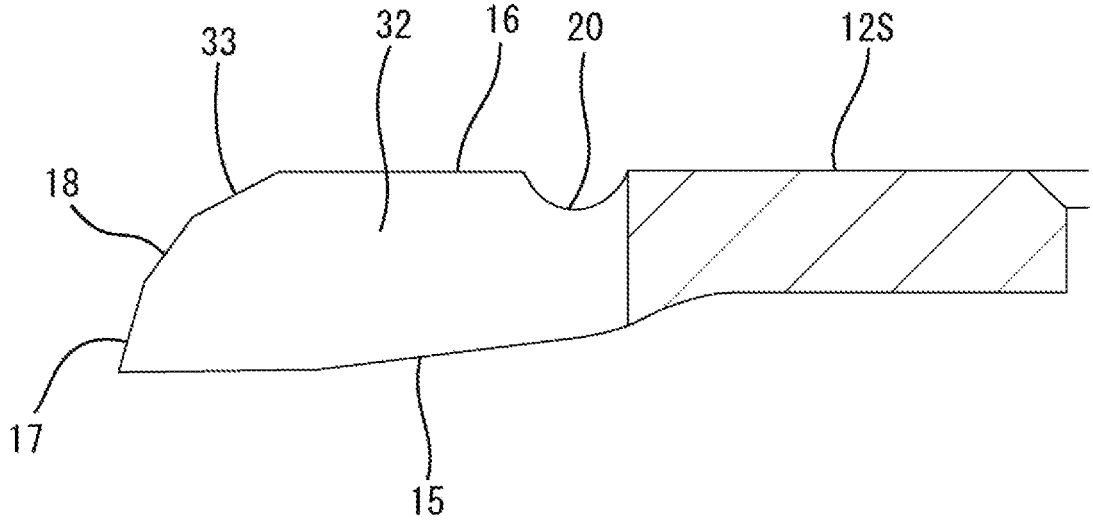
FIG. 12 is an enlarged side view of a locking lance of a third embodiment.

FIG. 12 shows a locking lance 32 of a lower housing 12 according to a third embodiment of the invention. The front surface of this locking lance 32 includes first and second locking surfaces 17 and 18 similar to the locking lance 14 of the first embodiment and the locking lance 30 of the second embodiment. An area connecting the front surface (second locking surface 18) and a front end part of a stacking back surface 16 (surface where a recess 20 is formed), is a coupling flat surface 33 straight in a side view. A lower end part of the coupling flat surface 33 is connected at an obtuse angle to an upper end part of the second locking surface 18. A rear end part of the coupling flat surface 33 is connected at an obtuse angle to a front end part of the stacking back surface 16. In a free state of the locking lance 32, an angle of inclination of the coupling flat surface 33 with respect to a lower-side stacking surface 12S is smaller than that of the first locking surface 17 and that of the second locking surface 18. Note that the configuration other than the above is the same as in the first embodiment and, hence, is not described.

The invention is not limited to the above described and illustrated embodiments. For example, the following embodiments also are included in the scope of the invention.

Although the recess is disposed in the rear end part of the locking lance in the above embodiments, the recess may be in front of the rear end part of the locking lance.

The inner surface of the recess is composed only of the curved surface having a constant curvature in the above embodiments. However, the inner surface of the recess may have plural curved surfaces having different curvatures, or a curved surface and a flat surface or plural flat surfaces without including any curved surface.

The recess is exposed in the outer surface of the sub-housing in the above embodiments, the recess may not be exposed in the outer surface of the sub-housing.

The housing is formed by stacking the sub-housings in the above embodiments, but the housing may be a single member.

The front end of the locking lance has two flat locking surfaces with different angles of inclination in the above embodiments. However, the front surface of the locking lance may have only one flat locking surface with a constant angle of inclination, or a single curved surface having a constant curvature, or plural curved surfaces having different curvatures or a combination of a flat and curved surfaces.

LIST OF REFERENCE SIGNS

10 housing
11 upper sub-housing
12 lower sub-housing
13 terminal accommodation chamber
14 locking lance
17 first locking surface
18 second locking surface
20 recess
21 terminal fitting

What is claimed is:

1. A connector, comprising:

a housing formed with a terminal accommodation chamber extending from a rear end to a front end of the housing, the housing further having a wall extending laterally across the terminal accommodating chamber at a position between the front and rear ends;

a terminal fitting to be inserted into the terminal accommodation chamber from behind the housing;

a locking lance cantilevered forward from the wall so that the locking lance is disposed to face the terminal accommodation chamber, the locking lance being resiliently displaceable in a direction away from the terminal accommodation chamber in response to insertion of the terminal fitting and to return and enter the terminal accommodation chamber upon insertion of the terminal fitting; and a recess extending laterally across the locking lance on a side of the locking lance opposite to the terminal accommodation chamber and at a rear end part of the locking lance.

2. The connector of claim 1, wherein an inner surface of the recess includes a curved surface.

3. The connector of claim 2, wherein the housing is formed by stacking two sub-housings, in each of which the recess is exposed in an outer surface, such that the recesses of the two sub-housings are opposed to one another and face each other when the sub-housings are stacked.

4. The connector of claim 3, wherein a front surface of the locking lance includes:

a first locking surface for locking the terminal fitting from behind with the locking lance resiliently displaced; and a second locking surface for locking the terminal fitting from behind with a resilient displacement amount of the locking lance increased when the terminal fitting is displaced rearward from a locking position by the first locking surface.

5. The connector of claim 1, wherein an inner surface of the recess includes a curved surface.

6. The connector of claim 1, wherein the housing is formed by stacking two sub-housings, in each of which the recess is exposed in an outer surface, such that the recesses of the two sub-housings are opposed to one another and face each other when the sub-housings are stacked.

7. The connector of claim 1, wherein a front surface of the locking lance includes:

a first locking surface for locking the terminal fitting from behind with the locking lance resiliently displaced; and a second locking surface for locking the terminal fitting from behind with a resilient displacement amount of the locking lance increased when the terminal fitting is displaced rearward from a locking position by the first locking surface.

8. The connector of claim 1, wherein the recess is substantially adjacent the wall from which the locking lance is cantilevered.

* * * * *